US006044164A

United States Patent [19]

Ach-Kowalewski

[11] Patent Number: 6,044,164

[45] Date of Patent: Mar. 28, 2000

[54] HEARING AID PERMITTING SIMULTANEOUS PROGRAMMING AND ADJUSTMENT WITH A SINGLE PLUG

[75] Inventor: Gerhard Ach-Kowalewski, Effeltich, Germany

[73] Assignee: Siemens Audiologische Technik GmbH, Erlangen, Germany

[21] Appl. No.: 08/984,047

[22] Filed: Dec. 3, 1997

[30] Foreign Application Priority Data

Dec. 18, 1996 [DE] Germany ..... 196 52 794

[51] Int. Cl.[7] ..... H04R 25/00

[52] U.S. Cl. ..... 381/314; 381/312; 381/320; 381/321

[58] Field of Search ..... 381/312, 314, 381/320, 321, 323

[56] References Cited

U.S. PATENT DOCUMENTS

| | | |
|---|---|---|
| 4,947,432 | 8/1990 | Pholm . |
| 5,188,540 | 2/1993 | Haertl . |
| 5,404,407 | 4/1995 | Weiss . |
| 5,717,771 | 2/1998 | Sauer . |

FOREIGN PATENT DOCUMENTS

| | | |
|---|---|---|
| 36 42 828 A1 | 8/1987 | Germany . |
| 40 31 132 | 1/1991 | Germany . |
| 42 33 813 | 4/1993 | Germany . |
| 93 06 204 | 4/1993 | Germany . |
| WO 83/02212 | 6/1983 | WIPO . |

*Primary Examiner*—Curtis A. Kuntz
*Assistant Examiner*—P. Dabney
*Attorney, Agent, or Firm*—Hill & Simpson

[57] ABSTRACT

A programmable hearing aid has functional parts provided in the housing, such as a microphone, an amplifier circuit, an earphone, a current source, and a socket with electrical contacts, into which a plug of an external programming unit can be inserted. In addition, the hearing aid comprises an audio signal processing unit, so that during the programming of the hearing aid the audio signal processing unit can be simultaneously adjusted.

2 Claims, 1 Drawing Sheet

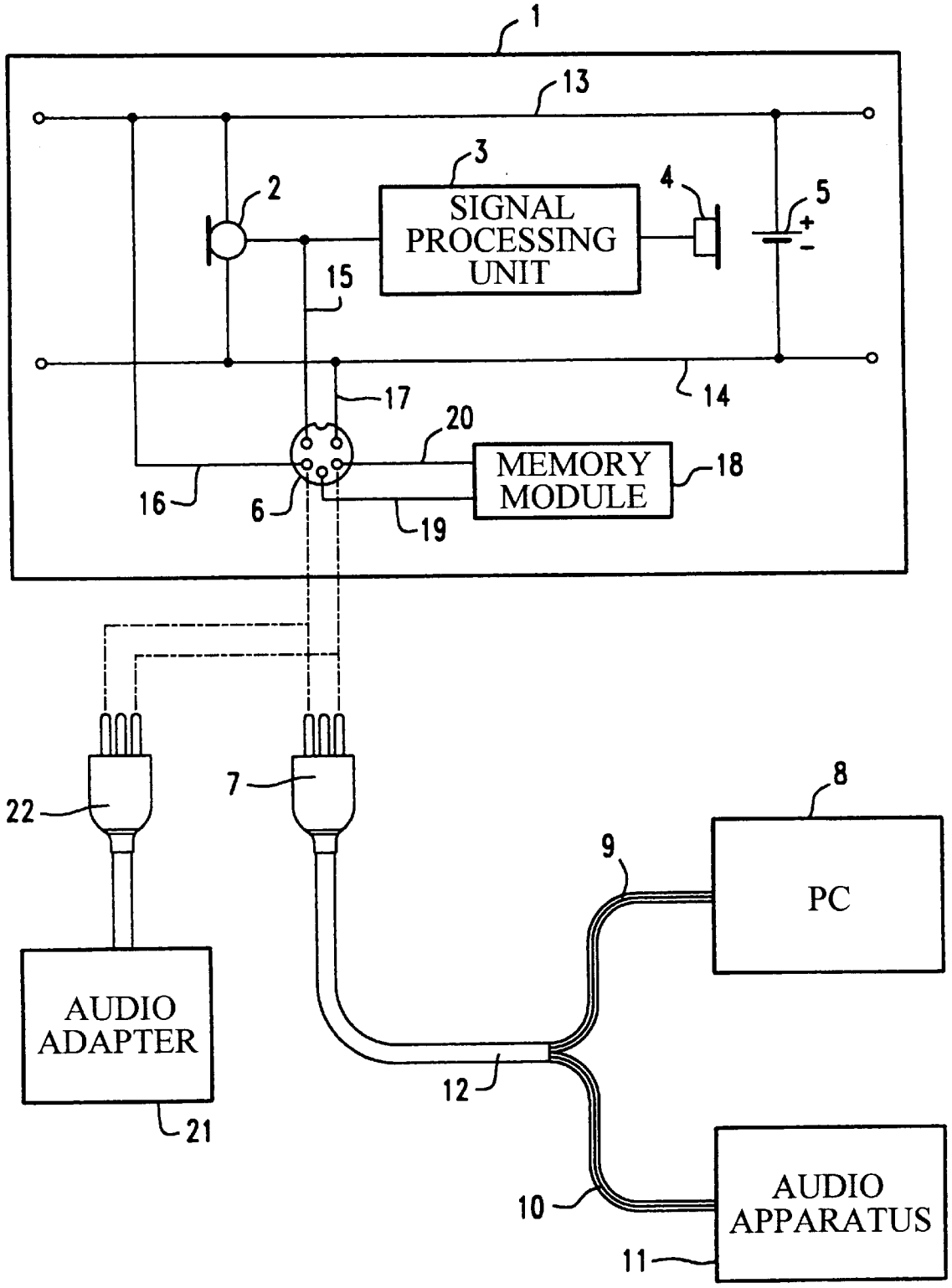
1
13
3
SIGNAL PROCESSING UNIT
2
4
5
+
-
15
14
17
20
MEMORY MODULE
18
16
6
19
22
7
8
9
PC
AUDIO ADAPTER
12
21
10
AUDIO APPARATUS
11

HEARING AID PERMITTING SIMULTANEOUS PROGRAMMING AND ADJUSTMENT WITH A SINGLE PLUG

BACKGROUND OF THE INVENTION

The invention relates to a programmable hearing aid with functional parts arranged in a housing, such as a microphone, a signal processing unit, an earphone, a power source and a socket with electrical contacts that can be connected to an external programming unit via an insertable plug, whereby via the socket at the housing side a programming circuit of the hearing aid can be supplied with setting data or can exchange data with the external programming unit.

A hearing aid of this type is known from DE 42 33 813, C1, corresponding to U.S. Pat. No. 5,404,407. In this known hearing aid, for the programming of the hearing aid programming circuit a programming plug is inserted into the programming socket, the plug being connected to an external programming unit via a programming cable. After the programming process, the programming plug is removed from the hearing aid socket. After the termination of the data transmission, and thus during the use of the hearing aid, an actuating element for the hearing aid can be inserted into the socket.

In the programmable hearing aid known from DE 40 31 132 A1,the programming contacts are optionally used as an audio input. For this purpose, an electronic switch is provided that is controlled by a memory module. The switch is switched on or off by the transmission of specific data signals to the memory module.

Finally, it is known in hearing aids that are on the market to provide contacts at the hearing aid housing for an audio connection, the contacts being capable of being contacted with an audio adapter to which an audio line can be coupled via a Euro plug. For the programming of the known hearing aid, programming contacts are provided at the housing, to which an additional adapter of a programming cable can be plugged, which can in turn be connected to a programming apparatus. In order to be able also to use terminals of the audio input of the hearing aid for the programming, audio terminals and programming terminals are combined at the hearing aid, and a controller is provided that is to be rotated to the "audio" or to the "programming" position, respectively.

SUMMARY OF THE INVENTION

It is an object of the invention to simplify the audio operations of a hearing aid. According to the invention, in a hearing aid of the type above, the hearing aid is provided with an audio signal processing unit, and during the programming of the hearing aid, the audio signal processing means can be adjusted at the same time. According to the invention, the audio signal processing is also adjusted during the programming of the hearing aid. According to the invention, a programming plug is placed in contact with the programming socket of the hearing aid for the programming of the hearing aid and of the audio signal processing. Via programming lines, the programming plug can be contacted, on the one hand, with an external programming apparatus, and at the same time, on the other hand, with an external audio apparatus, e.g. a radio. During use of this hearing aid with audio reception, an audio adapter can be inserted into the programming socket in a way known in itself.

BRIEF DESCRIPTION OF THE DRAWING

The drawing shows a switching diagram of a hearing aid according to the invention.

DESCRIPTION OF THE PREFERRED EMBODIMENTS

The programmable hearing aid comprises a microphone 2 in a housing 1, e.g. of a hearing aid that can be worn in or behind the ear, a signal processing unit 3 or amplifier unit being located in the signal path of the microphone to an earphone 4. For the power supply of the electrical components of the hearing aid, a battery 5 is provided, whereby, for example, electrical supply lines 13, 14 are drawn.

The hearing aid further comprises a socket 6 with electrical contacts, which can be connected via a plug 7 for programming the hearing aid, and serves as an audio input. Via the programming line or cable connection 12, the hearing aid can both be connected to e.g. a PC 8 by means of a wiring 9, and to an audio apparatus 11 by means of a line connection 10.

From the electrical contacts of the socket 6, audio lines 15, 16 lead to the supply lines 13, 14 of the hearing aid, and, in addition, a memory module 18 of the audio signal processing unit is connected to socket contacts via data lines 19, 20. Reference numeral 17 designates a frame terminal of the socket 6. If the plugged connection to the socket 6 becomes detached while the hearing aid is being worn, an audio adapter 21 can be inserted into the socket 6 via a plug 22 for audio reception during the use of the hearing aid.

Although various minor changes and modifications might be proposed by those skilled in the art, it will be understood that our wish is to include within the claims of the patent warranted hereon all such changes and modifications as reasonably come within our contribution to the art.

I claim as my invention:

1. A programmable hearing aid system, comprising:

a housing containing a hearing aid formed of a signal processing unit having a microphone connected thereto by a signal line and an earphone also connected thereto, a power source, a socket, and a memory module, the power source connected to supply power for the signal processing unit and also connecting to the socket, and the memory module and signal processing unit also connecting to the socket;

an insertable plug received by said socket; and said plug simultaneously connecting to both an external programming unit and an audio apparatus so that during programming of the hearing aid with the external programming unit the audio apparatus is employed to simultaneously adjust the hearing aid.

2. The system according to claim 1 wherein an audio adapter is insertable into the socket for audio reception given use of the programmable hearing aid system.

* * * * *